US005506472A

United States Patent [19]

Ito et al.

[11] Patent Number: 5,506,472

[45] Date of Patent: Apr. 9, 1996

[54] VARIABLE-FREQUENCY TYPE RADIO-FREQUENCY QUADRUPOLE ACCELERATOR INCLUDING QUADRUPOLE COOLING MEANS

[75] Inventors: Junya Ito, Hitachi; Katsumi Tokiguchi, Mito; Kensuke Amemiya, Katsuta; Noriyuki Sakudo, Hitachi, all of Japan

[73] Assignee: Hitachi, Ltd., Tokyo, Japan

[21] Appl. No.: 240,319

[22] Filed: May 10, 1994

[30] Foreign Application Priority Data

May 10, 1993 [JP] Japan ..... 5-108105

[51] Int. Cl.[6] ..... H05H 7/02; H01J 19/74

[52] U.S. Cl. ..... 315/5.41; 315/500; 315/505; 313/35; 313/36

[58] Field of Search ..... 315/5.41, 5.42, 315/500, 505; 313/359.1, 360.1, 35, 36

[56] References Cited

U.S. PATENT DOCUMENTS

| | | | |
|---|---|---|---|
| 4,490,648 | 12/1984 | Lancaster et al. | 315/5.41 |
| 4,712,042 | 12/1987 | Hamm | 315/5.41 |
| 4,801,847 | 1/1989 | Sakudo et al. | 315/5.42 X |
| 4,939,419 | 7/1990 | Bolie | 315/5.42 X |
| 5,334,943 | 8/1994 | Sawada | 315/5.41 X |

FOREIGN PATENT DOCUMENTS 233844 10/1991 Japan .

61900 5/1992 Japan .

OTHER PUBLICATIONS

Kapchinskii, I. M. and Teplyakov V. A.; "Linear Ion Accelerator with Spatially Homogeneous Focusing"; Pribory i Tekhnika Eksperimenta, No. 2, Mar./Apr. 1970; pp. 19–22.

*Primary Examiner*—Benny T. Lee
*Attorney, Agent, or Firm*—Antonelli, Terry, Stout & Kraus

[57] ABSTRACT

A secondary coil forming a resonant circuit in cooperation with a quadrupole is composed of conductive tubes and cooled by feeding coolant such as pure water into the tubes which serve as coolant passages. This makes it possible to minimize thermal deformation of the secondary coil when a variable-frequency type radio-frequency quadrupole accelerator is driven with a large amount of power. As a result, variation of the resonant frequency of the resonant circuit, resulting from the deformation of the secondary coil, can be minimized. Consequently, a given ion acceleration ability can be provided. When a coolant passage for use in cooling the primary coil is included and coolant such as pure water is fed into the coolant passage, thermal deformation of the primary coil can be minimized. Thus, impedance matching with the resonant circuit can be maintained on a stable basis. When the secondary coil is made by aligning several unit secondary coils in the axial direction of the quadrupole, the resonant frequency can be varied by mounting or dismounting the unit secondary coils independently.

8 Claims, 4 Drawing Sheets

VARIABLE-FREQUENCY TYPE RADIO-FREQUENCY QUADRUPOLE ACCELERATOR INCLUDING QUADRUPOLE COOLING MEANS

BACKGROUND OF THE INVENTION

1. Field of the Invention

The present invention relates to a variable-frequency type radio-frequency quadrupole accelerator for accelerating ions. More particularly, this invention is concerned with stabilization of a resonant frequency in a resonant circuit composed of a quadrupole and a secondary coil.

2. Background of the Invention

A radio-frequency quadrupole accelerator is a means for accelerating ions to produce high-energy ions. A variable-frequency type radio-frequency quadrupole accelerator (Japanese Patent Application Nos. 62-249400 and 3-245499, and U.S. Pat. No. 4,712,042) is known as a type of radio-frequency quadrupole accelerator enabling free variation of outgoing ion energy.

A conventional variable-frequency type radio-frequency quadrupole accelerator comprises a quadrupole composed of four elongated electrodes which are symmetrically arranged around a central axis and whose surface facing the axis undulates periodically, modulated, a secondary coil connected to the quadrupole and formed with a one-turn coil, and a primary coil magnetically coupled with the secondary coil. The secondary coil is connected to electrostatic capacitors constituting the quadrupole, thus forming a resonant circuit. The resonant circuit may be connected to a variable capacitor.

When power is supplied to the primary coil of the foregoing variable-frequency type accelerator over power supply lines, radio-frequency power is applied to the resonant circuit, which is composed of the electrostatic capacitors constituting the quadrupole and the secondary coil, via the secondary coil magnetically coupled with the primary coil. Consequently, ions are accelerated.

In general, the resonant frequency of a radio-frequency quadrupole accelerator is determined by the shapes of a quadrupole and a secondary coil. By generating a given voltage having a frequency equal to the resonant frequency among four electrodes of a quadrupole, ions are accelerated to an energy level dependent on three independent factors, that is, the structure of the modulation of the four elongated electrodes of the quadrupole, the resonant frequency, and the ion species. (I. M. Kapchinskii and V. A. Teplyakov, "Linear Ion Accelerator with Spatially Homogeneous Strong Focusing," UDC 621,385.64, "Nuclear Experimental Techniques," Plenum Publishing Corporation, New York, USA, 1970, p.322). Especially in a variable-frequency type radio-frequency quadrupole accelerator, the resonant frequency of the resonant circuit can be set to a desired value by, for example, changing the length or cross-sectional area of a secondary coil and thus varying the inductance of the secondary coil. Eventually, any given ions can be accelerated to various desired energies.

However, since a large amount of power is applied to the radio-frequency quadrupole accelerator, component members of the accelerator undergo thermal deformations due to an increase in temperature. This may cause the resonant frequency to vary. When the resonant frequency changes from a given value, one of the aforesaid factors determining ion energy varies. It therefore becomes impossible to accelerate given ions to the desired energy level.

As a means for solving the foregoing problem, a proposal has been made for a structure in which power is supplied to a quadrupole via a support column for supporting the quadrupole. In the structure, coolant is fed into the quadrupole and support column as well as the pedestal of the support column in order to cool them. Moreover, a cooling pipe is laid down along the support column, half embedded in the pedestal, and secured with a cooling pipe fixture (Japanese Patent Application Nos. 3-233844 and 4-61900).

However, in the foregoing prior art, the problem of preventing a thermal deformation of the secondary coil is not considered. The resonant frequency therefore varies due to a thermal deformation of the secondary coil. Given ions cannot therefore be accelerated to the desired energy level.

Impedance matching between a resonant circuit and power supply lines is attained by optimizing the shape and structure of a primary coil in a power line with the shape and structure of the resonant circuit. By attaining impedance matching, power supplied to the resonant circuit can be maximized.

However, impedance matching between a resonant circuit and power supply lines is impaired by the thermal deformations of a secondary coil forming the resonant circuit and of a primary coil. This poses the problem that power supply to the resonant circuit deteriorates.

An object of the present invention is to provide a variable-frequency type radio-frequency quadrupole accelerator capable of restraining thermal deformation of a secondary coil.

Another object of the present invention is to provide a variable-frequency type radio-frequency quadrupole accelerator capable of restraining an impedance change caused by thermal deformation of a power supply system.

SUMMARY OF THE INVENTION

To achieve the aforesaid objects, the present invention provides a variable-frequency type radio-frequency quadrupole accelerator comprising a quadrupole in which four elongated electrodes are symmetrically arranged around a central axis, a secondary coil being connected to the quadrupole and forming a resonant circuit in cooperation with the quadrupole, and a primary coil magnetically coupled with the secondary coil and having radio-frequency power supplied thereto. Coolant passages are formed in the secondary coil.

It is preferred that coil conductors of the secondary coil are formed with conductive tubes and the hollows of the tubes are used as the coolant passages. It is in particular preferred that a unit secondary coil is formed by arranging a plurality of conductive tubes in the form of a plane and joining both ends of the conductive tubes with the common coolant passages, and that a secondary coil is constructed by lining up a plurality of unit secondary coils in the axial direction of a quadrupole. A tube forming a coil conductor is preferably extending in a direction substantially parallel with the direction in which current flows through the coil conductor.

Alternatively, coil conductors of a secondary coil may be formed with conductive plate members. A cooling tube having a coolant passage therein is attached to the surface of a plate member, whereby a unit secondary coil is formed. Then, a secondary coil is constructed by lining up a plurality of unit secondary coils in the axial direction of the quadrupole.

When a secondary coil is constructed by lining up a plurality of unit secondary coils, the unit secondary coils are preferably mountable or dismountable on or from the quadrupole independently.

Preferably, a coolant passage is formed inside a conductor of a primary coil.

In this case, the primary coil is preferably replaceable with another one having a different shape or dimension.

With the aforesaid construction, according to the present invention, coil conductors of the secondary coil can be cooled by feeding coolant such as pure water into coolant passages formed in the conductors. Even when a variable-frequency type radio-frequency quadrupole accelerator is driven with a large amount of power, the thermal deformation of the secondary coil can be minimized.

As a result, a variation of the resonant frequency can be minimized. Consequently, given ions can be accelerated to a desired energy lever.

Thermal deformation of a primary coil can be minimized by cooling the primary coil. As a result, an impedance matching between a resonant circuit and power supply lines can be stabilized.

Using a secondary coil composed of a plurality of unit secondary coils, a resonant frequency can be varied effortlessly.

Preferred embodiments of the present invention will be described with reference to the drawings, in which like parts bear like reference numerals.

DESCRIPTION OF THE PREFERRED EMBODIMENTS

Figure 1:
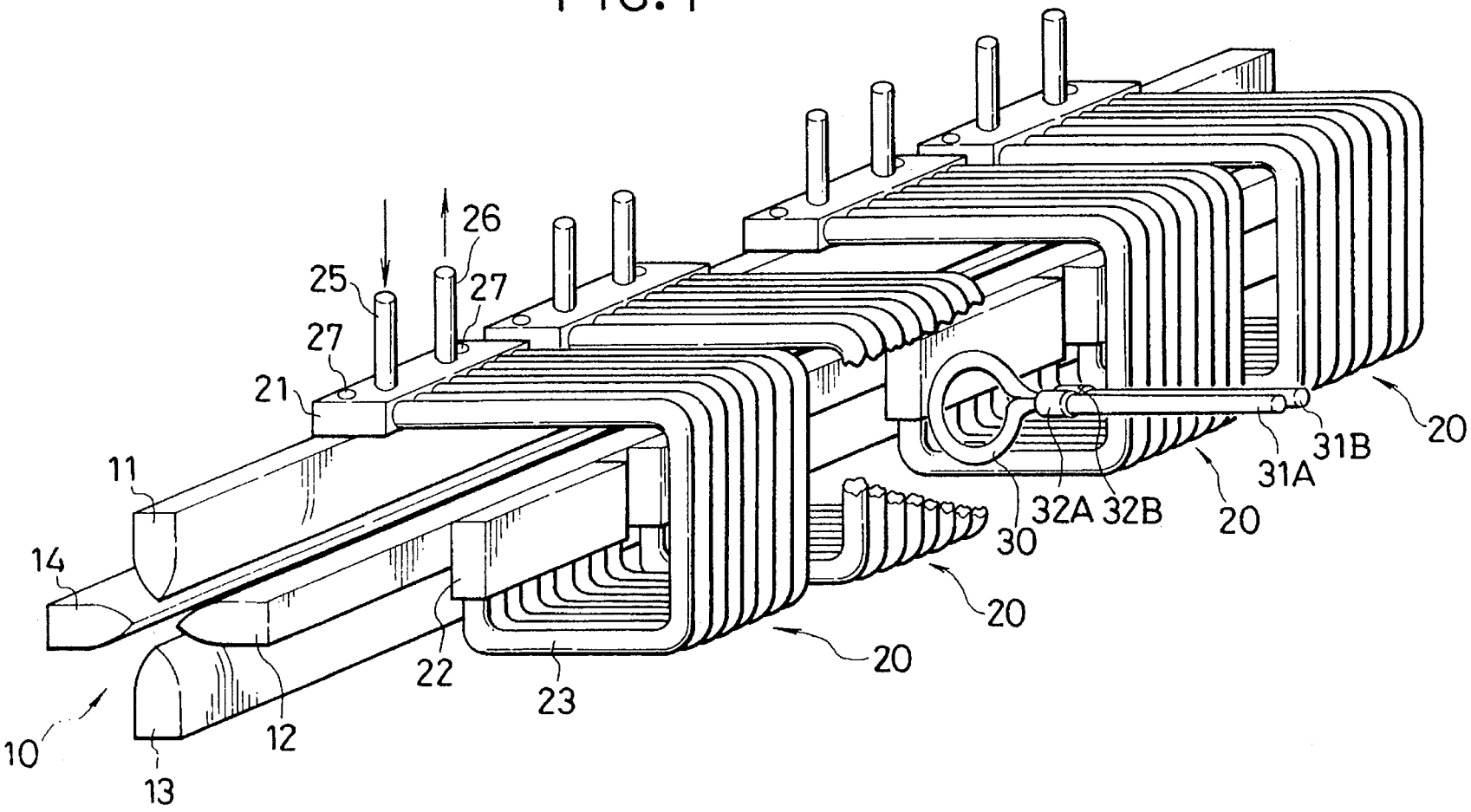
FIG. 1 is an oblique view showing an overall construction of an embodiment of a variable-frequency type radio-frequency quadrupole accelerator in accordance with the present invention.
Figure 2:
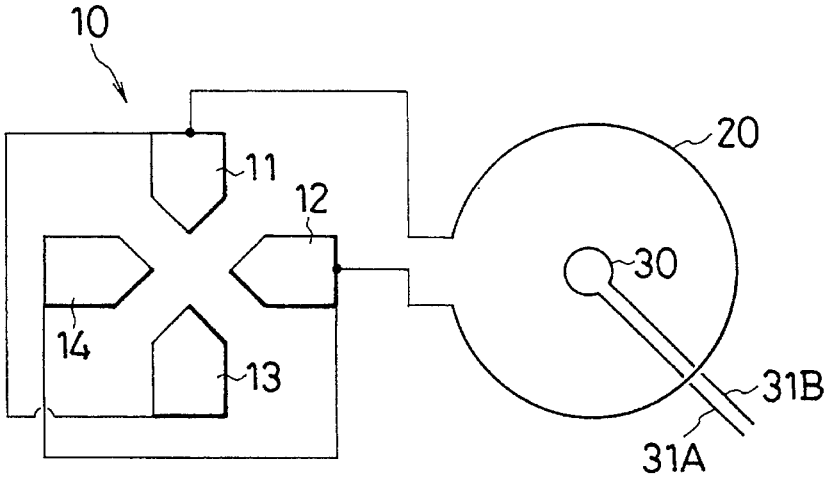
FIG. 2 is an equivalent circuit of the variable-frequency type radio-frequency quadrupole accelerator shown in FIG. 1.

FIG. 1 is an oblique view showing an overall construction of an embodiment of a variable-frequency type radio-frequency quadrupole accelerator in accordance with the present invention. FIG. 2 shows an equivalent circuit of the variable-frequency type radio-frequency quadrupole accelerator.

As shown in FIG. 1, the variable-frequency type radio-frequency quadrupole accelerator comprises a quadrupole 10 composed of four electrodes 11, 12, 13 and 14, a secondary coil composed of a plurality of unit secondary coils 20 joined with the quadrupole 10, a primary coil 30 magnetically coupled with the unit secondary coils 20, and power supply lines 31A, 31B for supplying power to the resonant circuit which is made up of the quadrupole 10 and secondary coil, via the primary coil 30. The electrodes 11, 12, 13 and 14, unit secondary coils 20, primary coil 30, and power supply lines 31A, 31B are made of a metal such as copper. The variable-frequency type radio-frequency quadrupole accelerator shown in FIG. 1 and FIG. 2 is encapsulated in a vacuum package.

The electrodes 11, 12, 13 and 14 are symmetrically arranged around a central axis, which is not shown in FIG. 1 for the sake of simplicity. As shown in FIG. 2, the pair of the upper and lower electrodes 11 and 13 are electrically connected to each other, and the pair of the right and left electrodes 12 and 14, are electrically connected to each other, in order to have the same potential.

Figure 3:
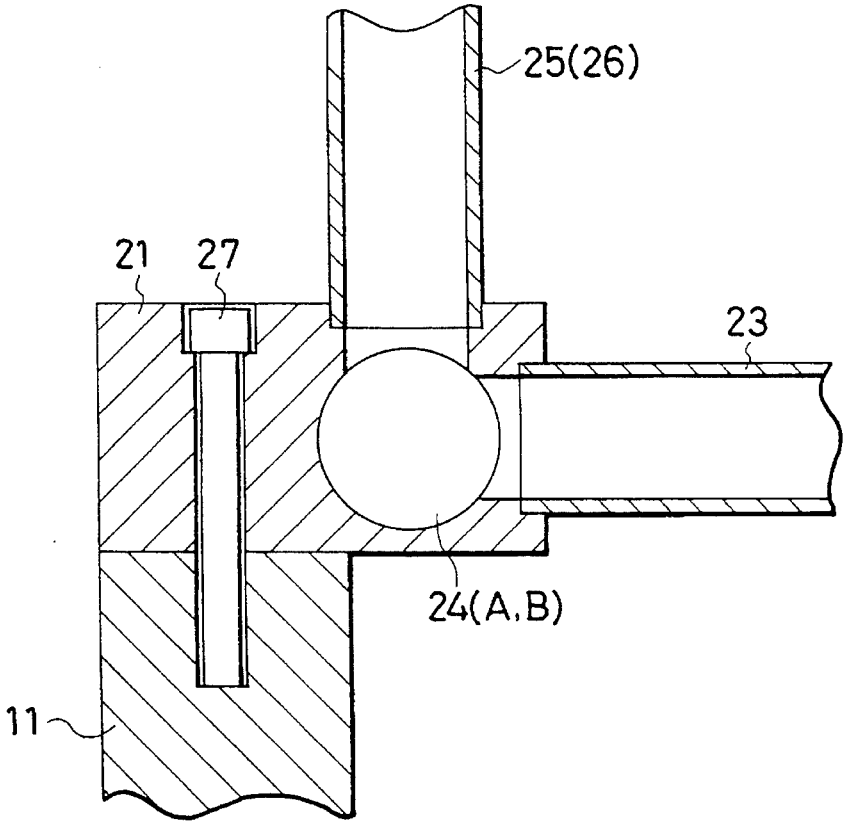
FIG. 3 is a sectional view partly showing a major portion of an example of a unit secondary coil.

Each of the unit secondary coils 20 is made by lining up eight conductive tubes 23, which are machined in the shape of a letter J, in the same direction. The two ends of the eight conductive tubes 23 are connected to two conductive headers 21 and 22 in which coolant passages are formed. As shown in FIG. 3, each of the tubes 23 has the inner passage joined with a coolant passage 24 (A, B) inside the header 21 (or 22). The coolant passage 24 (A, B) in the upper header 21 is partitioned longitudinally to create two chambers (24A and 24B), which are not illustrated. Returning to FIG. 1, the tubes 23 are communicating in fours with each of the two chambers. The two chambers of the coolant passage 24 in the header 21 for each unit secondary coil 20 are communicating with an intake tube 25 and a discharge tube 26 for coolant. The coolant passage in the lower header 22 remains undivided. The tubes 23, and headers 21 and 22 are made of a metal such as copper.

The unit secondary coils 20, each having the foregoing structure, are mounted on the quadrupole 10 by coupling the headers 21 and 22 with the electrodes 11 and 12 using bolts 27, so that the unit secondary coils can be dismounted easily. Thus, a resonant circuit is constructed.

The tubes 23 forming the unit secondary coils 20 lie in parallel with the direction of current flowing through the unit secondary coils 20, with the unit secondary coils 20 mounted on the quadrupole 10. In other words, the longitudinal directions of the tubes 23 is perpendicular to the axial direction of the quadrupole 10.

The number of unit secondary coils 20 to be mounted on the quadrupole 10 can be specified freely. In FIG. 1, the unit secondary coils 20 have the same shape. Alternatively, unit secondary coils 20 having different lengths (coil widths) in the axial direction of quadrupole 10 or different cross-sectional areas may be used in combination.

The unit secondary coils 20 may be constructed by using plate members having coolant passages therein as coil conductors instead of lining up a plurality of conductive tubes 23.

Figure 4:
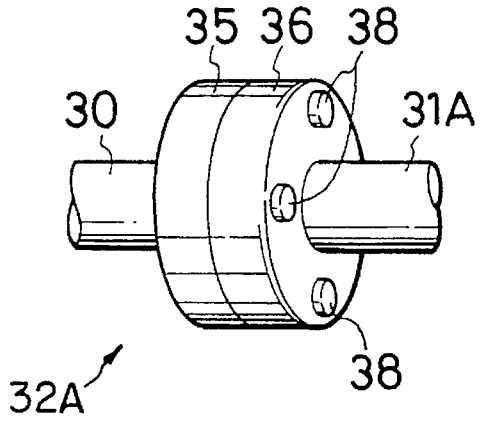
FIG. 4 is an oblique view showing an enlarged coupling for a primary coil and a power supply line.
Figure 5:
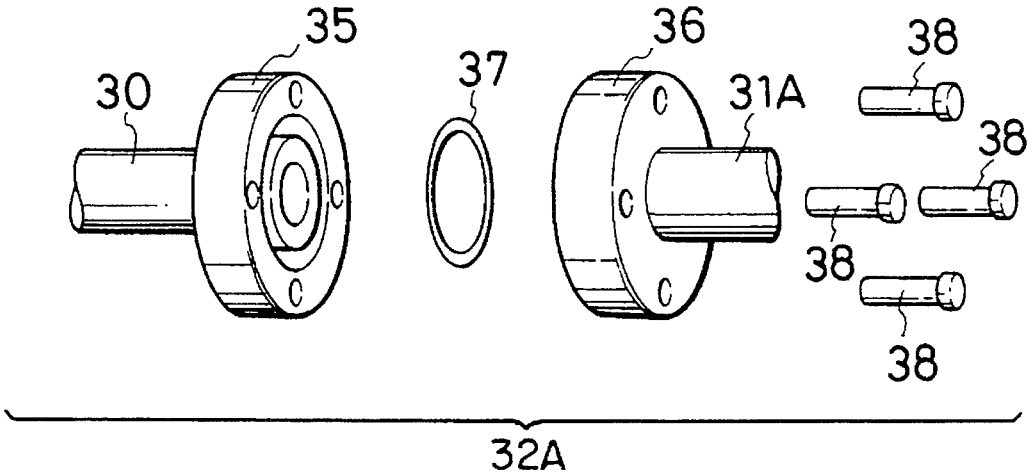
FIG. 5 is an oblique view showing an exploded coupling for a primary coil and a power supply line.

The primary coil 30 is made by machining a conductive tube circularly, and is connected to the power supply lines 31A and 31B via conductive couplings 32A and 32B. The primary coil 30 can be disconnected from the power supply lines 31A and 31B using the couplings 32A and 32B, and then replaced with another one having a different shape or dimension. The coupling 32A is structured as shown in FIGS. 4 and 5. The coupling 32B has the same structure. As illustrated, the coupling 32A is made by attaching a pair of flanges 35 and 36 with a rubber O ring 37 (FIG. 5) between them. The flanges 35 and 36 can be united with or separated from each other using bolts 38. An end of the primary coil 30 is coupled with the flange 35. An end of the power supply line 31A is coupled with the other flange 36. The flanges 35 and 36 are made of a metal such as copper. Connections with the primary coil 30 or with the power supply line 31A or 31B is accomplished by brazing.

The power supply lines 31A and 31B are formed with conductive tubes, and serve as supply paths for supplying coolant to the primary coil 30 or as discharge paths for discharging coolant circulated through the primary coil 30.

Next, the actions of this embodiment will be described. Each of the unit secondary coils 20 is a cylindrical one-turn coil. One unit secondary coil 20 or a plurality of unit secondary coils 20 are lined up in the axial direction of the quadrupole 10, whereby a one-turn secondary coil is constructed. The number of unit secondary coils 20 to be mounted can be changed, so that the overall length d of the secondary coil in the axial direction of the quadrupole 10 can be varied.

In general, the self-inductance L of a one-turn coil having an overall length d and a cross-sectional area S is expressed approximatively as the formula (1) below.

$$L_2 \cong \mu S/d \tag{1}$$

where, μ denotes permeability.

Assuming that the capacitance of the resonant circuit composed of the quadrupole 10 and the second coil is C, the resonant frequency thereof f is provided as the formula (2) below.

$$f = 1/2\pi\sqrt{L_2 C} \tag{2}$$

where, $L_2$ denotes the self-inductance of the secondary coil. When the resonant circuit is formed by mounting only the unit secondary coils 20 on the quadrupole 10, the capacitance C of the resonant circuit is equal to the electrostatic capacitance of the quadrupole 10. When the resonant circuit is formed by mounting the unit secondary coils 20 and a variable capacitor on the quadrupole 10, the capacitance C is equal to a combination of the electrostatic capacitance of the quadrupole 10 and the capacitance of the variable capacitor. The formula (1) reveals that the self-inductance $L_2$ of the secondary coil can be varied by changing the number of unit secondary coils 20 to be mounted, and the formula (2) reveals that the resonant frequency f of the resonant circuit can therefore be varied.

For attaining an impedance matching between the resonant circuit and the power supply lines 31A, 31B, a relationship expressed as the formula (3) below must be satisfied approximatively. (Refer to a Ph.D. dissertation entitled "Study of an RFQ Linac of a Four-Vane Type for Medium Heavy Ions," by Tetsuya Nakanishi, University of Tokyo.)

$$(N_2S_2/N_1S_1)^2 \times 1/Q_0 \times L_1/L_2 \times \{1+(R/W_0/L_1)^2\}/(R/W_0/L_1)=1 \tag{3}$$

where, $L_1$ denotes the self-inductance of the primary coil 30, $L_2$ denotes the self-inductance of the secondary coil, $S_1$ denotes the cross-sectional area of the primary coil 30, $S_2$ denotes the cross-sectional area of each unit secondary coil 20, $N_1$ denotes the number of turns of the primary coil 30, $N_2$ denotes the number of turns of the secondary coil, $Q_0$ denotes a Q value indicating the power efficiency of the resonant circuit, and R denotes the characteristic impedances of the power supply lines 31A, 31B. $W_0$ denotes a value calculated by multiplying the resonant frequency of a system, which is made up of the power supply lines 31A, 31B and the resonant circuit, by 2π. The $W_0$ value is substantially equal to a value calculated by multiplying the resonant frequency of the resonant circuit by 2π, which is expressed approximatively as the formula (4) below.

$$W_0 = 1/\sqrt{L_2 C} \tag{4}$$

where, C denotes the capacitance of the resonant circuit. In the variable-frequency type radio-frequency quadrupole accelerator of this embodiment, first, the resonant frequency f of the resonant circuit is set to a certain value; that is, the self-inductance $L_2$ of the secondary coil and the capacitance C of the resonant circuit are set to a certain value. With the values taken into consideration, the self-inductance $L_1$ of the primary coil 30, the cross-sectional area $S_1$ thereof, and the number of turns thereof are set to values that satisfy the relationship of the formula (3).

By replacing the primary coil 30 with another one having a different shape and dimension, the self-inductance $L_1$, cross-sectional area $S_1$, or number of turns $N_1$ of the primary coil 30 can be changed. Consequently, when the shape and dimension of the primary coil 30 are determined so that the relationship of the formula (3) is satisfied, impedance matching is attained between the resonant circuit and power supply lines 31A, 31B.

Each of the unit secondary coils 20 has such a structure that a plurality of conductive tubes 23 are placed in parallel with one another. The conductive tubes 23 are extending substantially in parallel with the direction of current flowing through the tubes 23. In FIG. 1, the longitudinal directions of the tubes 23 is perpendicular to the axial direction of the quadrupole 10. This structure brings about the shortest paths of current flowing through the tubes 23 or the unit secondary coils 20. The electric resistance of the secondary coil is substantially minimized. As a result, heat generated by the current flowing through the secondary coil is minimized. In other words, the ratio of radio-frequency power converted into heat energy to radio-frequency power applied to the resonant circuit is minimized. The loss of radio-frequency power is held to a minimum.

As mentioned above, in this embodiment, the unit secondary coils 20 are formed with the conductive tubes 23, and the conductive headers 21 and 22 having coolant passages therein. All the unit secondary coils 20 can be cooled forcibly.

Thermal deformation of the unit secondary coils 20 can therefore be minimized. As a result, even when a large amount of power is supplied, variations in the resonant frequency can be minimized. Since the primary coil 30 is formed with a conductive tube, the whole primary coil 30 can be cooled forcibly and thermal deformation of it can be minimized.

Since the thermal deformations of the primary coil 30 and unit secondary coils 20 are thus minimized, even when a large amount of power is supplied, impedance matching can be attained between the resonant circuit composed of the quadrupole 10 and unit secondary coils 20, and the power supply lines 31A, 31B.

In this embodiment, a secondary coil is formed by connecting one unit secondary coil 20 or a plurality of unit secondary coils 20 side by side to the quadrupole 10. The self-inductance of the secondary coil can therefore be varied by changing the number of unit secondary coils 20 to be connected to the quadrupole 10. The resonant frequency can be varied effortlessly.

Next, the actions and operation of the variable-frequency type radio-frequency quadrupole accelerator of this embodiment will be described in detail on the assumption that up to six unit secondary coils 20 can be connected to the quadrupole 10. In this case, the resonant frequency can be varied in six steps. In FIG. 1, four unit secondary coils 20 are connected to the quadrupole 10.

The electrostatic capacitance of the quadrupole 10 shall be 540 pF. The cross-sectional area of the secondary coil is an area of a section perpendicular to the axis of the quadrupole 10 in a space surrounded by the unit secondary coils and quadrupole 10, which shall be 0.137 $m^2$. The overall length of the secondary coil can be changed in six steps of 0.248 m, ranging from 0.24 m attained when only one unit secondary coil 20 is mounted to 1.48 m attained when six unit secondary coils 20 are mounted. The relationship among the number of unit secondary coils 20 to be mounted, the self-inductance $L_2$ of the secondary coil, and the resonant frequency f is shown in Table 1 below.

TABLE 1

| The number of unit secondary coils | 1 | 2 | 3 | 4 | 5 | 6 |
|---|---|---|---|---|---|---|
| $L_2$ [μH] | 0.278 | 0.198 | 0.157 | 0.127 | 0.112 | 0.0978 |
| f [MHz] | 13.0 | 15.4 | 17.3 | 19.2 | 20.5 | 21.9 |

The values of the inductances of secondary coils listed in Table 1 are calculated by multiplying the approximate values of inductances, which are calculated using the formula (1), by correction coefficients associated with the shapes of the secondary coils. As apparent from Table 1, the resonant frequency can be varied in six steps in the range from 13.0 MHz to 21.9 MHz by changing the number of unit secondary coils 20 to be mounted.

The unit secondary coils 20 in this embodiment are six divisions of a secondary coil. When the width of each unit secondary coil 20 is reduced in order to increase the number of divisions of a secondary coil, so that a larger number of unit secondary coils can be used to form a secondary coil having the same self-inductance as the aforesaid one, the resonant frequency can apparently be varied more finely.

In this embodiment, unit secondary coils having different widths can be mounted on the quadrupole 10. Using unit secondary coils whose widths are smaller than those of the unit secondary coils shown in FIG. 1, the resonant frequency can be varied even more finel);.

The aforesaid formulas (1) and (2) imply that the resonant frequency can be varied by changing the cross-sectional area of a secondary coil; that is, the cross-sectional areas of the unit secondary coils 20. In this embodiment, unit secondary coils having different cross-sectional areas can be mounted on the quadrupole 10. The resonant frequency can therefore be varied depending on the unit secondary coils having different cross-sectional areas.

Next, an example of an action of the variable-frequency type radio-frequency quadrupole accelerator of this embodiment will be described in detail concerning impedance matching between the resonant circuit composed of the quadrupole 10 and secondary coil, and the power supply lines 31A, 31B. In this embodiment, the primary coil 30 can be replaced with another one having a different shape or dimension by means of the couplings 32A and 32B. Once a primary coil having an appropriate shape and dimension is determined using the aforesaid formulas (1) to (4), impedance matching can be achieved easily between the resonant circuit composed of the quadrupole 10 and secondary coil, and the power supply lines 31A, 31B.

First, assume that four unit secondary coils 20 are mounted on the quadrupole 10 as shown in FIG. 1. Lecher wires whose characteristic impedances R are 75 ohms are employed as the power supply lines 31A, 31B. Since four unit secondary coils 20 are mounted on the quadrupole 10, the Q value, $Q_0$, of the resonant circuit composed of the quadrupole 10 and secondary coil is 2400. Table 1 indicates that the self-inductance $L_2$ of the secondary coil is 0.127 μH and the cross-sectional area $S_2$ thereof is 0.137 $m^2$. The number of turns of the secondary coil, $N_2$, is 1. The resonant frequency is calculated as 19.2 MHz according to the formula (2). $W_0$ is calculated as $1.21\times10^8$ [1/S] according to the formula (4). A cooling tube having an outer diameter of 12 mm is used as the primary coil 30. Assuming that the number of turns of the primary coil 30 is 1 and the diameter thereof is 90 mm, the cross-sectional area $S_1$ of the primary coil 30 is 0.00636 $m^2$, and the self-inductance $L_1$ of the primary coil 30 is 0.133 μH. Thus, the relationship of the formula (3) is satisfied.

As mentioned above, when the number of unit secondary coils 20 is four, a cooling tube whose outer diameter is 12 mm is used to create a one-turn coil having a diameter of 90 mm as the primary coil 30. The primary coil 30 is coupled with the couplings 32A and 32B. Thus, impedance matching can be achieved effortlessly.

Figure 6:
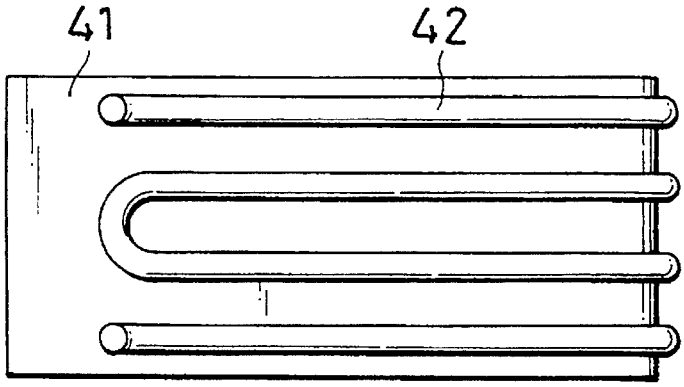
FIG. 6 is a plan view showing another embodiment of a unit secondary coil.
Figure 7:
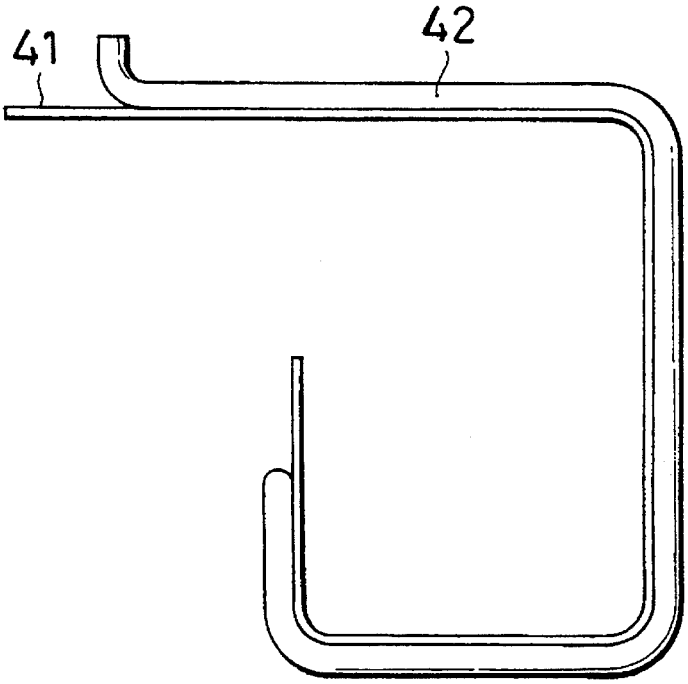
FIG. 7 is a side view showing the unit secondary coil shown in FIG. 6.

FIGS. 6 and 7 are a plan view and a side view showing a unit secondary coil in another embodiment of the present invention. The outer components are identical to those in the embodiment shown in FIG. 1. In the embodiment shown in FIG. 1, each unit secondary coil 20 is made by lining up eight conductive tubes 23 which are machined substantially in the form of a letter J, and joining the headers 21 and 22 having such a structure that the coolant passages 24 are formed in conductive plate members with both ends of the tubes 23. In contrast, in this embodiment, a unit secondary coil has such a structure that, as shown in FIGS. 6 and 7, a cooling tube 42 is attached to the surface of a conductive thin plate member 41 which is bent substantially in the form of a letter J.

In this embodiment, when the attachment of the cooling tube 42 to the thin plate member 41 is achieved by brazing, unlike when the attachment is achieved using a cooling tube fixture or the like, a problem that the cooling tube fixture is heated with radio-frequency power does not occur. A loss of radio-frequency power occurring when radio-frequency power is converted into heat energy can be held to a minimum.

In the aforesaid embodiments, a resonant circuit is composed of the quadrupole 10 and secondary coil. The present invention is not limited to this working mode. A resonant circuit may be made by mounting a secondary coil and a variable capacitor onto the quadrupole 10. A variable-frequency type radio-frequency quadrupole accelerator according to the present invention may still be realized.

With the aforesaid construction, according to the present invention, coil conductors of a secondary coil can be cooled by feeding coolant such as pure water into coolant passages formed in the coil conductors. Even when a variable-frequency type radio-frequency quadrupole accelerator is driven with a large amount of power, thermal deformation of the secondary coil can be minimized.

As a result, variation of the resonant frequency can be minimized. Given ions can therefore be accelerated to a desired energy.

A thermal deformation of the primary coil can be restrained by cooling the primary coil. As a result, impedance matching between the resonant circuit and power supply lines is stabilized.

When the secondary coil is formed using a plurality of unit secondary coils, the resonant frequency can be varied easily.

What is claimed is:

1. In a variable-frequency type radio-frequency quadrupole accelerator, the improvement comprising:

a quadruple having four elongated electrodes symmetrically arranged around a central axis;

a secondary coil aligned parallel to the central axis, connected to said quadrupole, and cooperating with said quadrupole to define therewith a resonant circuit;

a primary coil magnetically coupled to said secondary coil and adapted to have radio-frequency power supplied thereto; and means defining coolant passages for a coolant to cool said secondary coil, wherein:

said secondary coil comprises a plurality of conductive tubes lined up in parallel, each tube having a first end and second end, a first conductive header joining the first ends of said tubes, and a second consecutive header joining the second end of said tubes; and said coolant passages include common coolant passages disposed in said conductive headers and inner passages within said conductive tubes.

2. A variable-frequency type radio-frequency quadrupole accelerator according to claim 1, wherein said secondary coil comprises a plurality of unit secondary coils aligned in the direction of the central axis of said quadrupole.

3. A variable-frequency type radio-frequency quadrupole accelerator according to claim 2, further comprising means mounting said unit secondary coils on said quadrupole and permitting dismounting thereof.

4. A variable-frequency type radio-frequency quadrupole accelerator according to claim 1, further comprising means defining a further coolant passage thermally coupled to said primary coil, for passage of a coolant to cool said primary coil.

5. In a variable-frequency type radio-frequency quadrupole accelerator, the improvement comprising:

a quadrupole having four elongated electrodes symmetrically arranged around a central axis;

a secondary coil aligned parallel to the central axis, connected to said quadrupole, and cooperating with said quadrupole to define therewith a resonant circuit;

a primary coil magnetically coupled to said secondary coil and adapted to have radio-frequency power supplied thereto; and means defining coolant passages for a coolant to cool said secondary coil, wherein:

said secondary coil includes a conductive plate member connected to said quadrupole; and said coolant passages include coolant tubes joined to the surface of said conductive plate member.

6. A variable-frequency type radio-frequency quadrupole accelerator according to claim 5, further comprising means defining a further coolant passage thermally coupled to said primary coil, for passage of a coolant to cool said primary coil.

7. A variable-frequency type radio-frequency quadrupole accelerator according to claim 5, wherein said secondary coil comprises a plurality of unit secondary coils aligned in the axial direction of said quadrupole.

8. A variable-frequency type radio-frequency quadrupole accelerator according to claim 7, further comprising means mounting said unit secondary coils on said quadrupole and permitting dismounting thereof.

* * * * *